US012245635B2

(12) United States Patent
Garcia Garcia

(10) Patent No.: US 12,245,635 B2
(45) Date of Patent: Mar. 11, 2025

(54) VAPOR GENERATING SYSTEM FOR AN ELECTRONIC CIGARETTE

(71) Applicant: JT International SA, Geneva (CH)

(72) Inventor: Eduardo Jose Garcia Garcia, Grand-Saconnex (CH)

(73) Assignee: JT International S.A. (CH)

( * ) Notice: Subject to any disclaimer, the term of this patent is extended or adjusted under 35 U.S.C. 154(b) by 357 days.

(21) Appl. No.: 17/773,353

(22) PCT Filed: Oct. 28, 2020

(86) PCT No.: PCT/EP2020/080214
§ 371 (c)(1),
(2) Date: Apr. 29, 2022

(87) PCT Pub. No.: WO2021/083918
PCT Pub. Date: May 6, 2021

(65) Prior Publication Data

US 2023/0148672 A1 May 18, 2023

(30) Foreign Application Priority Data

Oct. 31, 2019 (EP) ..... 19206543

(51) Int. Cl.
*A24F 40/48* (2020.01)
*A24F 40/10* (2020.01)
(Continued)

(52) U.S. Cl.
CPC ..... *A24F 40/48* (2020.01); *A24F 40/10* (2020.01); *A24F 40/42* (2020.01); *A24F 40/485* (2020.01);
(Continued)

(58) Field of Classification Search
CPC ..... A24F 40/48; A24F 40/53; A24F 40/485; A24F 40/10; A24F 40/42; A24F 40/51; A24F 40/60
(Continued)

(56) References Cited

U.S. PATENT DOCUMENTS

2011/0036436 A1* 2/2011 Haltmayer ..... D06F 39/081 137/872
2014/0034070 A1 2/2014 Schennum
(Continued)

FOREIGN PATENT DOCUMENTS

JP 2018143765 A 9/2018
JP 2019500857 A 1/2019
(Continued)

OTHER PUBLICATIONS

International Search Report for Application No. PCT/EP2020/080214 mailed Apr. 12, 2021, pp. 1-7.

*Primary Examiner* — Gary F Paumen
(74) *Attorney, Agent, or Firm* — Lerner David LLP

(57) ABSTRACT

A vapor generating system for an electronic cigarette comprises a main liquid store configured to contain a liquid to be vaporised, a dosing chamber configured to receive liquid from the main liquid store, and a liquid regulating arrangement configured to transfer a metered dose of liquid from the main liquid store to the dosing chamber. The vapor generating system further comprises a vaporizing unit configured to transform said metered dose of liquid into a vapor. The main liquid store and the dosing chamber are arranged in a replaceable cartridge. The cartridge is connectable to a cartridge seating of the electronic cigarette, and fluidic connection between the main liquid store and the dosing chamber is only established when the cartridge is connected to the cartridge seating.

20 Claims, 6 Drawing Sheets

(51) Int. Cl.

| | |
|---|---|
| ***A24F 40/42*** | (2020.01) |
| ***A24F 40/485*** | (2020.01) |
| ***A24F 40/51*** | (2020.01) |
| ***A24F 40/53*** | (2020.01) |
| ***A24F 40/60*** | (2020.01) |

(52) U.S. Cl.
CPC ..... *A24F 40/51* (2020.01); *A24F 40/53* (2020.01); *A24F 40/60* (2020.01)

(58) Field of Classification Search
USPC ..... 131/329
See application file for complete search history.

(56) References Cited

U.S. PATENT DOCUMENTS

| | | | | |
|---|---|---|---|---|
| 2015/0342258 | A1 | 12/2015 | Chen | |
| 2016/0331023 | A1* | 11/2016 | Cameron | A61M 11/041 |
| 2017/0135398 | A1* | 5/2017 | Scott | A61M 11/042 |
| 2018/0249763 | A1 | 9/2018 | Schmidt et al. | |
| 2019/0110519 | A1* | 4/2019 | Meyer | A24F 40/30 |
| 2019/0124982 | A1 | 5/2019 | Atkins et al. | |
| 2019/0223507 | A1* | 7/2019 | Qiu | A24F 40/53 |
| 2019/0223512 | A1* | 7/2019 | Nakano | H05B 3/10 |
| 2019/0272359 | A1* | 9/2019 | Popplewell | G06F 21/32 |

FOREIGN PATENT DOCUMENTS

| | | | |
|---|---|---|---|
| WO | 2015079197 | A1 | 6/2015 |
| WO | 2018144964 | A1 | 8/2018 |
| WO | 2018165758 | A1 | 9/2018 |

* cited by examiner

VAPOR GENERATING SYSTEM FOR AN ELECTRONIC CIGARETTE

CROSS-REFERENCE TO RELATED APPLICATIONS

The present application is a national phase entry under 35 U.S.C. § 371 of International Application No. PCT/EP2020/080214, filed on Oct. 28, 2020, published in English, which claims priority from European Application No. 19206543.1 filed Oct. 31, 2019, the disclosures of all of which are incorporated herein by reference.

TECHNICAL FIELD

The present disclosure relates generally to electronic cigarettes, and in particular to a vapor generating system for an electronic cigarette.

TECHNICAL BACKGROUND

The term electronic cigarette, or e-cigarette, is usually applied to a handheld electronic device that simulates the feeling or experience of smoking tobacco in a traditional cigarette. Common e-cigarettes work by heating an aerosol-generating liquid to generate a vapor that cools and condenses to form an aerosol which is then inhaled by the user.

Accordingly, using e-cigarettes is also sometimes referred to as "vaping". The aerosol-generating liquid in the electronic cigarette usually comprises nicotine, propylene glycol, glycerin and flavorings. The aerosol-generating liquid is sometimes also designated as "e-liquid" or simply as "liquid", for short.

Typical e-cigarette vaporizers, i.e. systems or sub-systems for vaporizing the liquid, utilize a cotton wick and heating element to produce vapor from liquid stored in a capsule or tank. When a user operates the e-cigarette, liquid that has soaked into the wick is heated by the heating element, producing a vapor which cools and condenses to form an aerosol which may then be inhaled.

The electronic cigarette is a battery-operated device that needs frequent recharging. A typical user needs to recharge the electronic cigarette every 2-3 days.

Typically, in known prior art vaporizers, a liquid store is provided, and liquid is transferred to the vaporizer by the wick. The wick continuously supplies liquid to the vaporizer (which is often a heating element). The wick thus establishes a constant fluid connection between the liquid store and the heating element. Consequently, there is a problem with stray heat that reaches the liquid store.

In view of the above-mentioned drawbacks, it is an object of the present disclosure to provide an electronic cigarette with improved energy efficiency.

SUMMARY OF THE DISCLOSURE

According to a first aspect of the present disclosure, there is provided a vapor generating system for an electronic cigarette, the vapor generating system comprising:

- a main liquid store configured to contain a liquid to be vaporised;
- a dosing chamber configured to receive liquid from the main liquid store;
- a liquid regulating arrangement, wherein the liquid regulating arrangement is configured to transfer a metered dose of liquid from the main liquid store to the dosing chamber; and

- a vaporizing unit configured to transform said metered dose of liquid into a vapor.

By delivering a metered and predetermined dose of liquid from the main liquid store to the dosing chamber, the constant fluid connection between the liquid store and the vaporizing unit is eliminated. This in turn reduces unwanted heat transfer from the vaporizing unit to the main liquid store and other components, but which is not sufficient to vaporize the liquid. This improves the energy efficiency and reduces the energy consumption of the electronic cigarette. Energy efficiency is also improved because the separate dosing chamber is in thermal contact with the vaporizing unit, whereas the main liquid store can be thermally isolated from the vaporizing unit.

As used herein, the term "electronic cigarette" may include an electronic cigarette configured to deliver an aerosol to a user, including an aerosol for smoking. An aerosol for smoking may refer to an aerosol with particle sizes of 0.5 to 10 μm. The particle size may be less than 10 or 7 μm. The electronic cigarette may be portable.

In general terms, a vapor is a substance in the gas phase at a temperature lower than its critical temperature, which means that the vapor can be condensed to a liquid by increasing its pressure without reducing the temperature, whereas an aerosol is a suspension of fine solid particles or liquid droplets, in air or another gas. It should, however, be noted that the terms 'aerosol' and 'vapor' may be used interchangeably in this specification, particularly with regard to the form of the inhalable medium that is generated for inhalation by a user.

The vaporizing unit may be located inside the dosing chamber. This arrangement may facilitate the transformation of the metered dose of liquid into a vapor.

The dosing chamber may be located inside the main liquid store. This arrangement may facilitate the transfer of the metered dose of liquid from the main liquid store to the dosing chamber by the liquid regulating arrangement and/or may simplify the structure of the vapor generating system.

The vaporizing unit may be located at the bottom of the dosing chamber, and may form a bottom wall of the dosing chamber. Contact between the metered dose of liquid and the vaporizing unit is thereby assured.

The vaporizing unit may comprise a heater. The heater may be flat. The heater may comprise a porous material and may be configured to absorb liquid. The use of a heater may be particularly convenient for transforming the metered dose of liquid into a vapor.

The main liquid store may comprise a liquid outlet and the dosing chamber may comprise a liquid inlet. Fluid communication between the main liquid store and the dosing chamber is thereby assured.

The main liquid store and the dosing chamber may be arranged in a replaceable cartridge, for example a sealed cartridge in which the main liquid store cannot be refilled or a refillable cartridge in which the main liquid store can be refilled by a user of the electronic cigarette. Thus, the liquid containing components are advantageously provided as a separate component.

The cartridge may be connectable to a cartridge seating of the electronic cigarette, and a fluidic connection between the main liquid store and the dosing chamber may only be established when the cartridge is connected to the cartridge seating. Thus, the liquid is securely retained in the main liquid store prior to connection of the replaceable cartridge to the cartridge seating.

The main liquid store and the dosing chamber may both comprise a pierceable membrane, which may be configured to be pierced open by the liquid regulating arrangement.

The liquid regulating arrangement may comprise a valve. The valve can be electrically controlled to open in response to a signal from a controller. The flow of liquid from the main liquid store to the dosing chamber can be free flowing when the valve is opened in response to the signal from the controller. The use of a valve allows a metered dose of liquid to be supplied from the main liquid store to the dosing chamber in a simple manner.

The liquid regulating arrangement may comprise a pump. A liquid transfer conduit may extend from the main liquid store to the dosing chamber and the pump may be arranged on the liquid transfer conduit. The use of a pump may allow an accurate metered dose of liquid to be supplied from the main liquid store to the dosing chamber via the liquid transfer conduit.

The liquid transfer conduit may be arranged to eject liquid onto the vaporizing unit located vertically below. Such an arrangement ensures that the metered dose of liquid comes into contact with the vaporizing unit.

The metered dose may correspond to one inhalation. The energy efficiency of the electronic cigarette is thereby maximized, and at the same time the amount of aerosol generated by the vaporizing unit and delivered to the user can be carefully controlled.

The vapor generating system may further comprise a controller which may be configured to activate the liquid regulating arrangement in response to an activation of the electronic cigarette. Thus, the liquid regulating arrangement is operable to transfer a metered dose of liquid from the main liquid store to the dosing chamber only when the electronic cigarette is activated.

The vapor generating system may further comprise an inhalation sensor which may be configured to detect the presence of an inhalation and activate the vaporizing unit. Alternatively, the electronic cigarette may comprise a push-button to activate the vaporizing unit. Either way, the vaporizing unit is operated only when necessary, contributing to the improved energy efficiency of the electronic cigarette.

The controller may be configured, upon detecting a first activation of the electronic cigarette, to provide a delay between the supply of a first metered dose of said liquid from the main liquid store to the dosing chamber and activation of the vaporizing unit. This ensures that the vaporizing unit is primed and that a sufficient amount of aerosol is generated upon first use of the electronic cigarette, thereby avoiding a "dry puff". The first activation could either be a first puff or the activation of a push-button by a user.

The controller may be configured to determine the delivered dose over time. This may allow a user to track their consumption.

The controller may be further configured to detect depletion of the main liquid store, for example by deducting the volume of each metered dose of liquid transferred to the dosing chamber from the initial and known volume of liquid contained in the main liquid store. The controller could be configured to generate a user alert upon detecting depletion of the main liquid store and/or to deactivate the liquid regulating arrangement (e.g. pump or valve) and/or the vaporizing unit. Further use of the electronic cigarette may, therefore, be prevented, for example until a replacement cartridge is connected to the cartridge seating of the electronic cigarette.

The vapor generating system may further comprise a control interface via which a user may select and change the predetermined dose via the control interface. This may allow the user to optimize the characteristics of the vapor and thereby provide an enhanced user experience.

DETAILED DESCRIPTION OF EMBODIMENTS

Figure 1A:
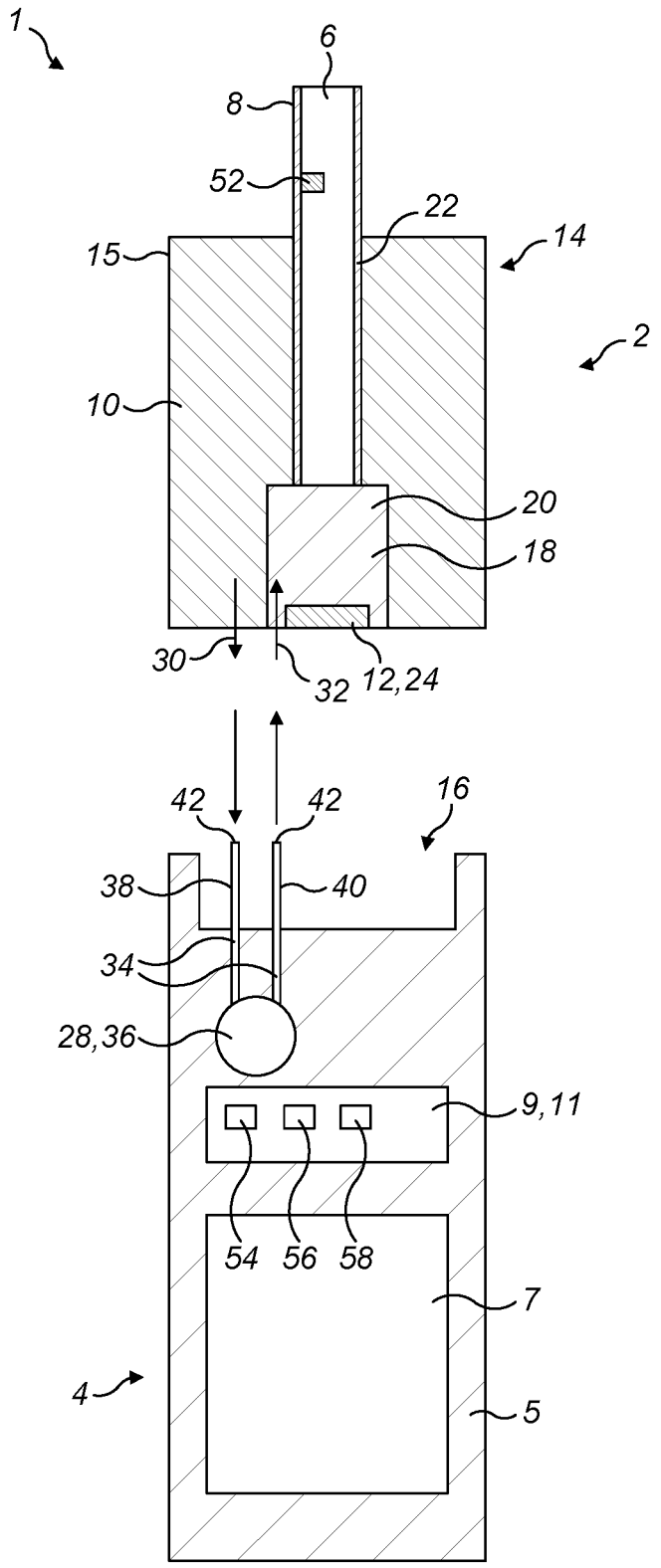
FIG. 1*a* is a schematic cross-sectional view of an electronic cigarette including a vaporizing unit according to an embodiment of the present disclosure.

Embodiments of the present disclosure will now be described by way of example only and with reference to the accompanying drawings in which like features are denoted with the same reference numerals.

Referring to FIG. 1*a*, an electronic cigarette 1 according to an embodiment of the present disclosure is illustrated. The electronic cigarette 1 comprises a mouthpiece portion 2, a power supply portion 4 and an exterior housing 5. The power supply portion 4 can also be referred to as a main body 4 of the electronic cigarette 1, which is advantageously configured as a re-usable unit, and comprises a power supply unit 7 and control circuitry 9 to operate the electronic cigarette 1.

The electronic cigarette 1 further comprises a main liquid store 10 and a vaporizing unit 12. The vaporizing unit 12 is configured to receive liquid from the main liquid store 10 and to heat the liquid to a temperature at which vaporization occurs (typically between about 190° C. and 290° C.).

Figure 1B:
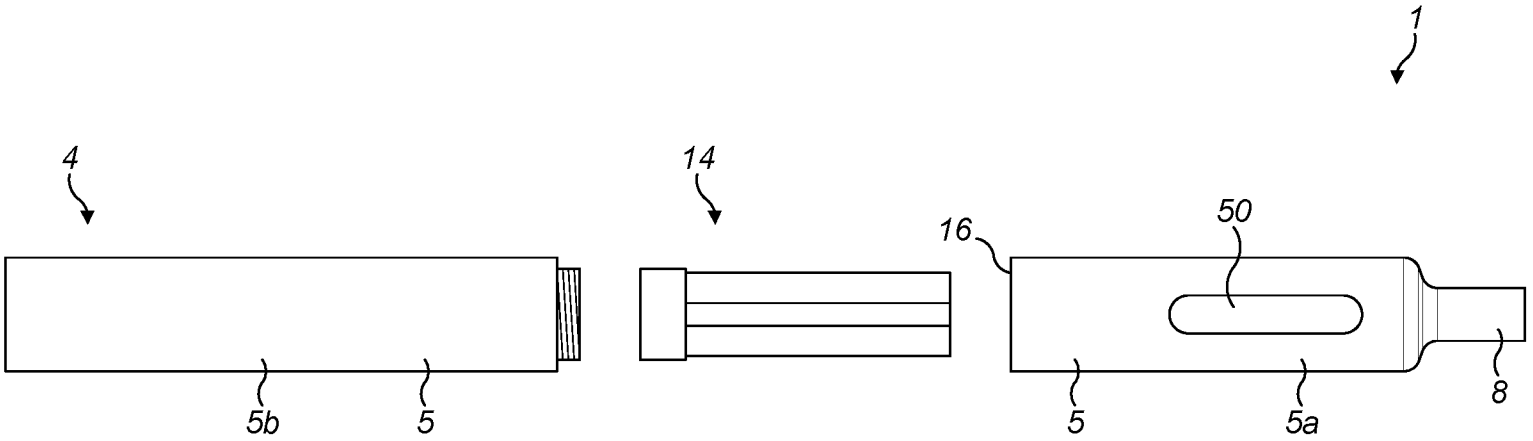
FIG. 1*b* is a schematic view of an electronic cigarette according to another embodiment of the present disclosure.

As illustrated in FIGS. 1*a* and 1*b*, the main liquid store 10 can be included in a disposable cartridge 14. The main body 4 comprises a cartridge seating 16 configured to receive the cartridge 14. As illustrated in FIG. 1*a*, the cartridge 14 comprises a vapor outlet 6 and may further comprise a mouthpiece 8.

As illustrated in FIG. 1*b*, the electronic cigarette 1 may comprise a mouthpiece portion housing 5*a* which is removably connectable to a main body housing 5*b* and a separate mouthpiece 8 located on the mouthpiece portion housing 5*a*. The cartridge 14 can be enclosed within the housing 5 of the electronic cigarette 1 when the main body housing 5*b* and the mouthpiece portion housing 5*a* are connected.

As best seen in FIG. 1*a*, the cartridge 14 comprises a main liquid store 10 and a dosing chamber 18. A vaporizing unit 12 and a vaporization chamber 20 are located inside the dosing chamber 18. A vapor flow tube 22 extends from the vaporization chamber 20 to the vapor outlet 6. As vapor generated in the vaporization chamber 20 flows along the vapor flow tube 22, it cools and condenses to form an aerosol that is delivered to the user via the mouthpiece 8.

The vaporizing unit 12 may comprise a heating element 24. In other (non-illustrated) embodiments of the present disclosure, the vaporizing unit 12 may be configured as a nebulizer (e.g. comprising a vibrating mesh) instead of a heating element 24.

Figure 2A:
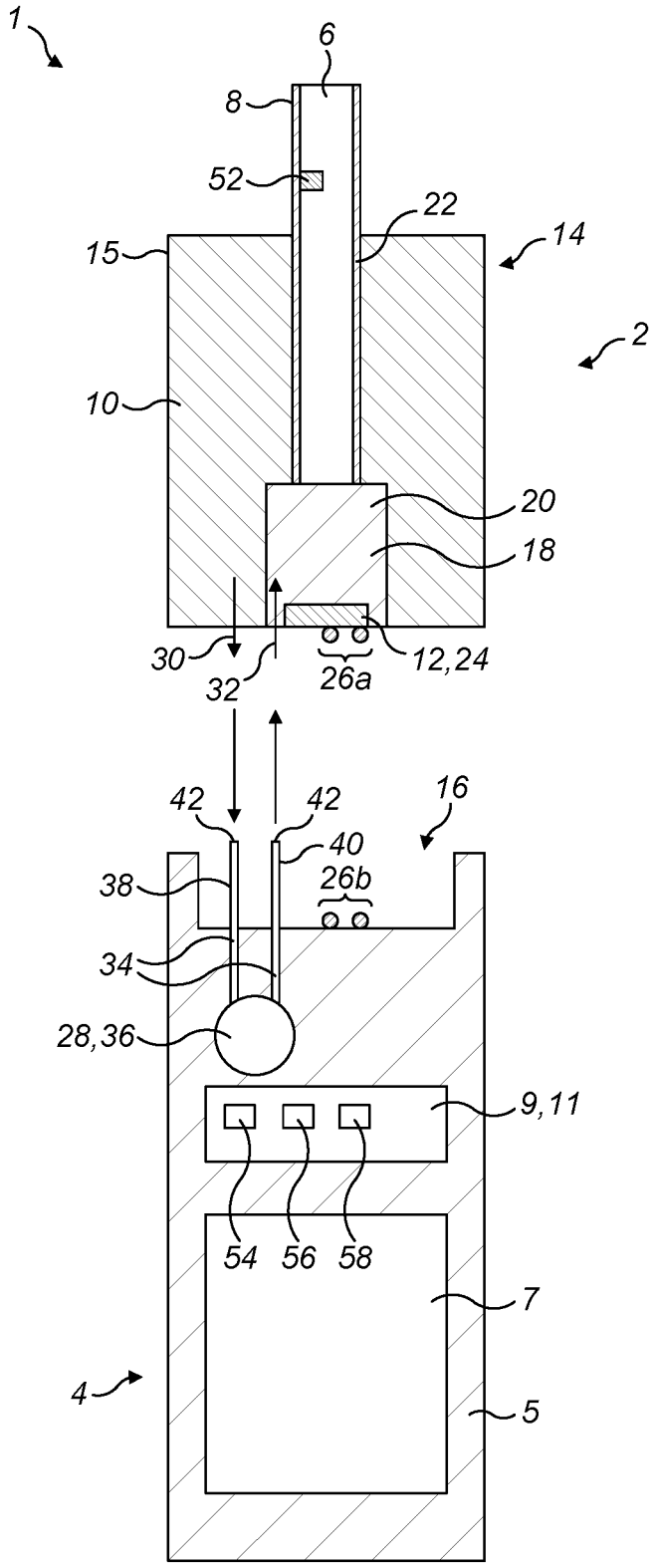
FIGS. 2*a* and 2*b* are schematic cross-sectional views similar to FIG. 1*a*, showing different embodiments of a vaporizing unit according to the present disclosure.

As seen in FIG. 2*a*, the heating element 24 can be a resistive heating element 24 which is located inside the dosing chamber 18 and directly connected to the power circuit from the power supply unit 7. The heating element 24 is connected to the power circuit with corresponding electrical terminals 26*a*, 26*b* located respectively on the cartridge 14 and in a cartridge seating 16 of the main body 4.

Figure 2B:
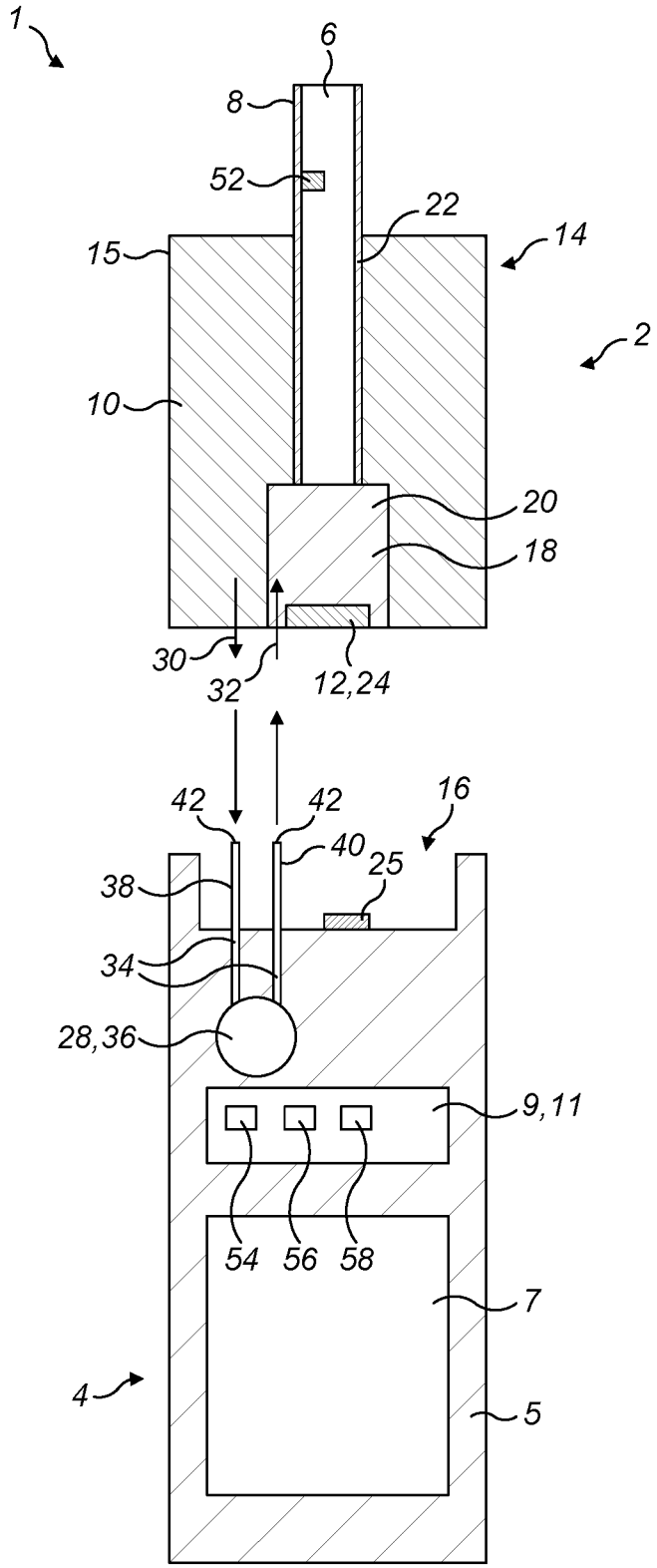

Alternatively, as illustrated in FIG. 2*b*, the heating element 24 can comprise a heat transfer element 24 which is heated by conduction from a stationary heater 25 arranged on the main body 4. The heat transfer element 24 may be flat and made from a metal sheet, formed for instance of stainless steel or alloys thereof. The heat transfer element 24 may advantageously form a wall of the dosing chamber 18 and form an outer portion of the cartridge housing 15. This enables the heat transfer element 24 to be in direct contact with the stationary heater 25 and in thermal contact with the liquid in the dosing chamber 18. The stationary heater 25 may comprise a resistive heating element integrated in a supporting substrate such as an insulator (ceramic or glass) in order to provide mechanical stability.

The dosing chamber 18 is fluidically connected to the main liquid store 10 via a liquid regulating arrangement 28. The main liquid store 10 is provided with a liquid outlet 30 and the dosing chamber 18 is provided with a liquid inlet 32. The liquid regulating arrangement 28 is arranged on a liquid transfer conduit 34 extending between the liquid outlet 30 of the main liquid store 10 and the liquid inlet 32 of the dosing chamber 18. The liquid regulating arrangement 28 is configured to control the transfer of liquid between the main liquid store 10 and the dosing chamber 18, and in particular to transfer a metered dose of liquid from the main liquid store 10 to the dosing chamber 18. The metered dose corresponds to a predetermined volume of liquid.

As illustrated in FIG. 1*a*, the liquid regulating arrangement 28 may be configured to pressurize the liquid in order to induce a flow of liquid from the main liquid store 10 to the dosing chamber 18. The liquid regulating arrangement 28 typically comprises a pump 36. The pump 36 can for instance be a piezoelectric pump. The pump 36 is arranged in the main body 4.

Figure 4:
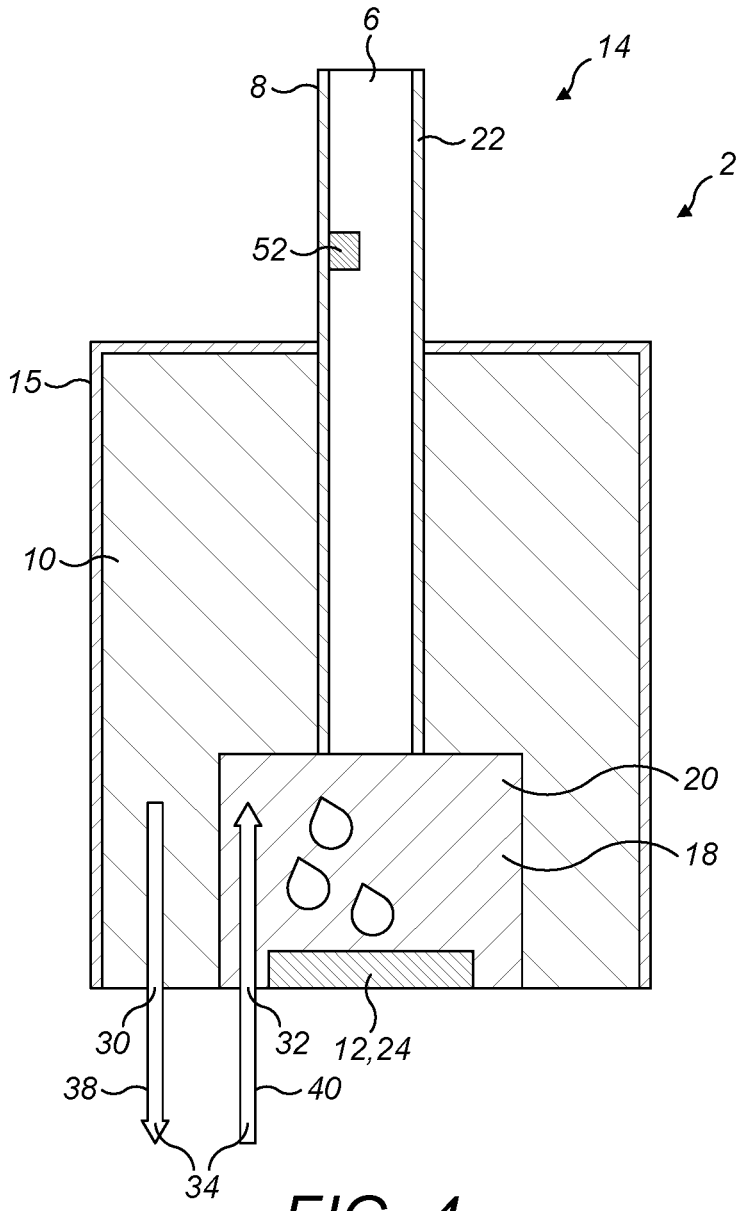
FIG. 4 is a schematic cross-sectional view of an exemplary liquid delivery member.

The main body 4 comprises a liquid uptake member 38 and a liquid release member 40 which can both formed by the liquid transfer conduit 34. The members 38, 40 are configured to establish a fluidic connection between the liquid outlet 30 and liquid inlet 32. The members 38, 40 can be provided with piercing ends 42 such that they can open the main liquid store 10 and the dosing chamber 18. As illustrated in FIG. 4, the liquid release member 40 can be arranged to dispense liquid at a position vertically above the heating element 24. Alternatively, the liquid release member 40 can be configured to supply liquid on a lower surface of the heating element 24 that is positioned vertically above the liquid release member 40. In this embodiment, the heating element 24 may comprise a porous material, such as a ceramic, which enables the liquid to rise upwards from the lower surface to the upper surface of the heating element 24 so that it can evaporate/vaporize from the upper surface.

The liquid outlet 30 of the main liquid store 10 and the liquid inlet 32 to the dosing chamber 18 are preferably provided with a re-closable membrane (not shown). The membrane reduces the risk of liquid leaking from the cartridge 14 when the cartridge 14 is removed from the cartridge seating 16.

Figure 3:
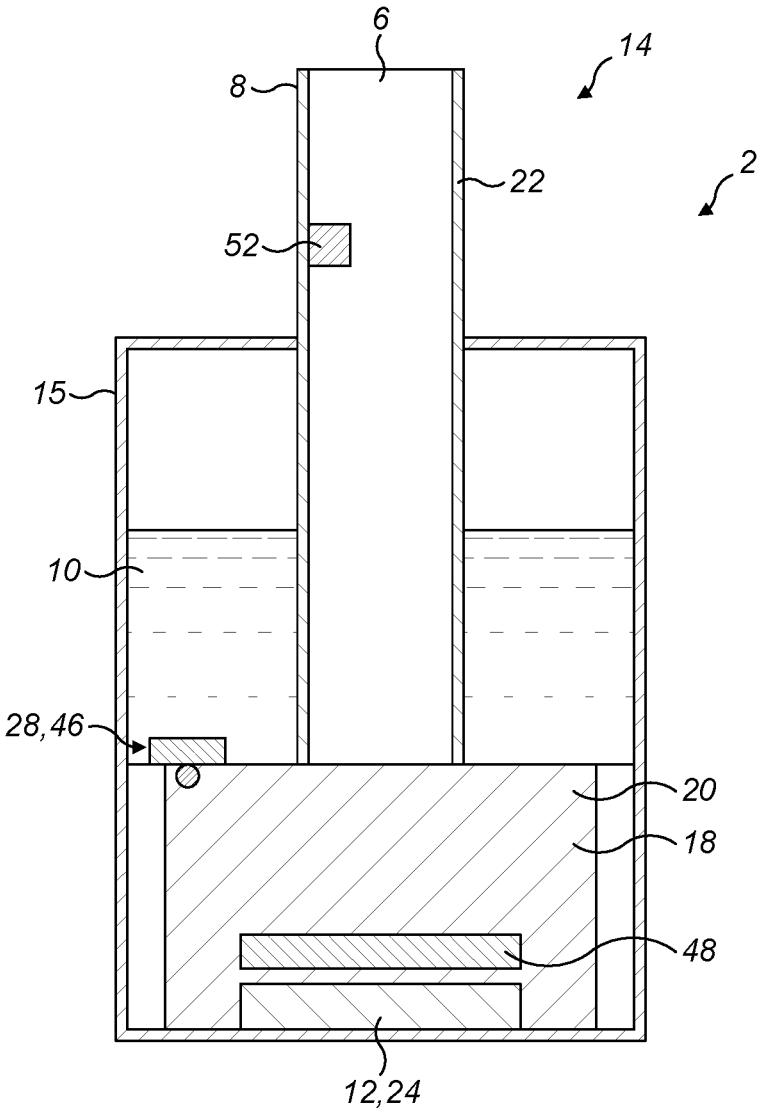
FIG. 3 is an exemplary embodiment of a liquid regulating arrangement in the form of a valve.

Alternatively, as illustrated in FIG. 3, the liquid regulating arrangement 28 may comprise a valve 46 which may be located on the liquid transfer conduit 34. In order to further transport the liquid into the direct proximity of the heating element 24, the liquid regulating arrangement 28 may be fluidically connected to a wick 48, arranged inside the dosing chamber 18 and in contact with the heating element 24. Preferably, the valve 46 is located above the heating element 24 such that the liquid transfer can be provided by gravitational force.

Additionally, both for the valve and the pump liquid transfer arrangements, the dynamic pressure applied from the inhalations of a user may be used to further contribute to the flow of liquid from the main liquid store 10 to the dosing chamber 18.

The heating element 24 may be operated by a push button 50 (see FIG. 1*b*). The push button 50 is configured to operate an electrical switch to enable power supply from the power supply unit 7. Alternatively, the heating element 24 can be activated by an inhalation sensor 52, such as an airflow sensor. The inhalation sensor 52 is configured to detect an inhalation and in response to activate the heating element 24. The liquid regulating arrangement 28 may be activated in response to a signal from the push button 50 or the inhalation sensor 52. The control circuitry 9 may further comprise a memory 54 and a timer 56, wherein the memory 54 contains instructions regarding the interaction between the inhalation sensor 52, the liquid regulating arrangement 28 and the heating element 24.

Preferably, the heating element 24 is only activated once the liquid regulating arrangement 28 has delivered a metered dose of liquid from the main liquid store 10 to the dosing chamber 18. This ensures that the heating element 24 is provided with sufficient liquid when it is activated.

The memory 54 can include a program including a series of instructions to be executed in steps.

In a first step S1, the electronic cigarette 1 is activated. This will for instance mean that the electronic cigarette is activated in a switched-on state. Alternatively, a first inhalation or the activation of the push button 50 can be detected as an activation step.

In a second step S2, the liquid regulating arrangement 28 delivers a metered dose of liquid from the main liquid store 10 to the dosing chamber 18.

In an optional step before step S2 above, the electronic cigarette 1 may be configured such that it determines activation by the detection of an inhalation. In that case, the control circuitry 9 may be configured to introduce a delay (i.e. longer than for the following inhalations) between the detection of the inhalation such that a first metered dose of liquid is delivered from the main liquid store 10 to the dosing chamber 18 before the activation of the heating element 24.

In a third step S3, the heating element 24 is activated to vaporize the metered dose of liquid transferred from the main liquid store 10 to the dosing chamber 18.

In a fourth step S4, the control circuitry 9 determines the end of a session and, for example, disables the liquid regulating arrangement 28. The end of the session can either be determined by disabling the device on a control interface (such as the push button 50). Alternatively, the inhalation sensor 52 may provide a signal that the inhalation has ended and may deactivate the liquid regulating arrangement 28. Still in another embodiment, the control circuitry 9 can detect inactivity by defining when no inhalation or heating element 24 activation has been detected after a certain time threshold.

At the end of a session, stray heat still remains at the heating element 24 which may enable the remaining liquid on the heating element 24 to evaporate.

Another advantage of the present disclosure is that the dosage can be controlled by the user. The present electronic cigarette 1 can provide a variable vapor volume. The supply rate (volumetric flow) can be changed by the liquid regulating arrangement 28. This can be done by configuring the pump 36 to supply a variable dose (e.g. the speed of the pump can be modified). This can also be done by changing the amount of time that the liquid regulating arrangement 28 is activated. Alternatively, the amount of opening and the duration of the time the valve 46 is opened can also be changed.

The control circuitry 9 may further comprise a controller 11, configured to control the heating element 24 in response to the amount of liquid. The controller 11 can change either the temperature or the duration of activation of the heating element 24, or a combination of both. The larger the metered dose delivered from the main liquid store 10 to the heating element 24 in the dosing chamber 18, the greater the cooling effect. This makes it an advantage to increase the temperature of the heating element 24. It may be advantageous to only modify the activation time of the heating element 24, as this would be simpler than to modify the power supply to the heating element 24.

The memory 54 may comprise at least one program of a dosage regime. The program may set limitations to the frequency and the dose delivered. As previously discussed, the electronic cigarette 1 according to the present disclosure provides a very precise control of the actual dose delivered in a metered way. The program may comprise a dosage schedule to reduce the delivered nicotine content over time, in embodiments in which the liquid is a nicotine-containing liquid. Alternatively, the program can measure the consumed amount of liquid and set limitations over time to avoid excessive use. The program may also comprise different delivery regimes, e.g., higher nicotine delivery in the mornings and lower in the evenings.

The dosage-control of the present electronic cigarette 1 is thus not limited by the shortcomings of prior art wick-type vaporizers and provides a significantly more accurate measurement of delivered liquid amounts. This is because the inherent capillary flow characteristics of prior art wicks have a constant and open fluidic connection between the liquid store and the heating element as well as variable liquid supply at different ambient temperatures and atmospheric pressures.

The electronic cigarette 1 may further comprise a communication unit 58, enabling connection to a remote computing device such as a computer or mobile telephone. The communication unit 58 is configured to receive instructions and transfer the instructions to the controller 11. The controller 11 can then modify the program in the memory according to the received instructions. The instructions may include a dosage regime.

The skilled person will realize that the present disclosure is by no means is limited to the described exemplary embodiments. The mere fact that certain measures are recited in mutually different dependent claims does not indicate that a combination of these measures cannot be used to advantage. Moreover, the expression "comprising" does not exclude other elements or steps. Other non-limiting expressions include that "a" or "an" does not exclude a plurality and that a single unit may fulfil the functions of several means. Any reference signs in the claims should not be construed as limiting the scope. Finally, while the disclosure has been illustrated in detail in the drawings and in the foregoing description, such illustration and description is considered illustrative or exemplary and not restrictive; the disclosure is not limited to the disclosed embodiments.

The invention claimed is:

1. A vapor generating system for an electronic cigarette, the vapor generating system comprising:

a main liquid store configured to contain a liquid to be vaporised;

a dosing chamber configured to receive liquid from the main liquid store;

a liquid regulating arrangement, wherein the liquid regulating arrangement is configured to transfer a metered dose of liquid from the main liquid store to the dosing chamber;

a vaporizing unit configured to transform said metered dose of liquid into a vapor; and a controller, wherein:

the main liquid store and the dosing chamber are arranged in a replaceable cartridge, the replaceable cartridge is connectable to a cartridge seating of the electronic cigarette, and a fluidic connection between the main liquid store and the dosing chamber is only established when the cartridge is connected to the cartridge seating, and the controller is configured to activate the liquid regulating arrangement in response to an activation of the electronic cigarette and, upon detecting a first activation of the electronic cigarette, to provide a delay between a supply of a first metered dose of said liquid and activation of the vaporizing unit.

2. The vapor generating system according to claim 1, wherein the vaporizing unit is located inside the dosing chamber.

3. The vapor generating system according to claim 1, wherein the dosing chamber is located inside the main liquid store.

4. The vapor generating system according to claim 1, wherein the vaporizing unit is located at a bottom of the dosing chamber.

5. The vapor generating system according to claim 1, wherein the main liquid store comprises a liquid outlet, and the dosing chamber comprises a liquid inlet.

6. The vapor generating system according to claim 1, wherein the main liquid store and the dosing chamber both comprise a pierceable membrane, configured to be pierced open by the liquid regulating arrangement.

7. The vapor generating system according to claim 1, wherein the liquid regulating arrangement comprises a valve.

8. The vapor generating system according to claim 1, wherein the liquid regulating arrangement comprises a pump.

9. The vapor generating system according to claim 8, wherein a liquid transfer conduit extends from the main liquid store to the dosing chamber, and wherein the pump is arranged on the liquid transfer conduit.

10. The vapor generating system according to claim 9, wherein the vaporizing unit is located vertically below the liquid transfer conduit, and wherein the liquid transfer conduit is arranged to eject liquid onto the vaporizing unit.

11. The vapor generating system according to claim 1, wherein the metered dose corresponds to a single inhalation by a user of the electronic cigarette.

12. The vapor generating system according to claim 1, further comprising an inhalation sensor configured to detect a presence of an inhalation and to activate the vaporizing unit.

13. The vapor generating system according to claim 1, wherein the controller is configured to determine an amount of the metered doses over time.

14. The vapor generating system according to claim 13, wherein the controller is further configured to detect depletion of the main liquid store.

15. The vapor generating system according to claim 1, further comprising a control interface, wherein a user can select and change a magnitude of the metered dose via the control interface.

16. The vapor generating system according to claim 4, wherein the vaporizing unit defines a bottom wall of the dosing chamber.

17. A vapor generating system for an electronic cigarette, the vapor generating system comprising:

a main liquid store configured to contain a liquid to be vaporised;

a dosing chamber configured to receive liquid from the main liquid store, wherein the dosing chamber is located inside the main liquid store;

a liquid regulating arrangement, wherein the liquid regulating arrangement is configured to transfer a metered dose of liquid from the main liquid store to the dosing chamber; and a vaporizing unit configured to transform said metered dose of liquid into a vapor; wherein:

the main liquid store and the dosing chamber are arranged in a replaceable cartridge, the replaceable cartridge is connectable to a cartridge seating of the electronic cigarette, and a fluidic connection between the main liquid store and the dosing chamber is only established when the cartridge is connected to the cartridge seating.

18. The vapor generating system according to claim 17, wherein the main liquid store comprises a liquid outlet, and the dosing chamber comprises a liquid inlet.

19. The vapor generating system according to claim 17, wherein the main liquid store and the dosing chamber both comprise a pierceable membrane, configured to be pierced open by the liquid regulating arrangement.

20. The vapor generating system according to claim 17, wherein the liquid regulating arrangement comprises a valve.

* * * * *